United States Patent [19]

Gula et al.

[11] Patent Number: 5,032,813

[45] Date of Patent: Jul. 16, 1991

[54] PINNED SHUNT END EXPANSION JOINT

[75] Inventors: Lance Gula, Aliquippa; Roger W. Helms, Beaver Falls, both of Pa.

[73] Assignee: Westinghouse Electric Corp., Pittsburgh, Pa.

[21] Appl. No.: 491,329

[22] Filed: Mar. 9, 1990

[51] Int. Cl.[5] ..... H01H 3/00

[52] U.S. Cl. ..... 335/195; 200/244; 335/16

[58] Field of Search ..... 335/16, 97, 147, 195, 335/196; 200/144 R, 147 R, 244

[56] References Cited

U.S. PATENT DOCUMENTS

| | | | |
|---|---|---|---|
| 2,732,453 | 1/1956 | Talbot | 200/244 |
| 3,263,051 | 2/1963 | Gauthier et al. | 200/244 |
| 4,242,577 | 12/1980 | Maier et al. | 200/244 |
| 4,489,295 | 12/1984 | Altenhof, Jr. et al. . | |
| 4,635,012 | 1/1987 | Kohanawa et al. | 335/16 |
| 4,638,277 | 1/1987 | Thomas et al. . | |
| 4,656,444 | 4/1987 | McKee et al. . | |
| 4,679,018 | 7/1987 | McKee et al. . | |
| 4,849,590 | 7/1989 | Becker et al. | 200/147 R |
| 4,891,618 | 1/1990 | Paton | 335/195 |

*Primary Examiner*—Leo P. Picard
*Assistant Examiner*—Lincoln Donovan
*Attorney, Agent, or Firm*—M. J. Moran

[57] ABSTRACT

A laminated contact assembly formed from a plurality of contact arm subassemblies includes a contact arm portion, for carrying a movable main or arcing contact, and a stationary conductor portion. A flexible shunt, form wound from a flat electrical conductor, is used to connect the contact arm portion to the stationary conductor portion. The flexible shunt is formed into a V-shape defining two depending legs. The free ends of the shunt defining bulb portions are inserted into keyholes formed in the contact arm portion and the stationary conductor portion. A pin is inserted into a central portion of the bulb portion to exert radially outward forces against the interior surface of the keyhole to increase the contact force between the bulb portions and the keyholes to form joints having a lower electrical resistance. The pin may be inserted into the central portion of the bulb portion by orbital riveting.

21 Claims, 3 Drawing Sheets

PINNED SHUNT END EXPANSION JOINT

CROSS-REFERENCE TO RELATED APPLICATIONS

The invention disclosed herein relates to molded case circuit breakers. The following patent applications all relate to molded case circuit breakers and were filed on Aug. 1, 1988: Ser. No. 226,503, entitled CROSS-BAR ASSEMBLY, by Jere L. McKee, Lance Gula and Glenn R. Thomas; and Ser. No. 226,655, entitled COMBINATION BARRIER AND AUXILIARY CT BOARD, by Gregg Nissly, Allen B. Shimp and Lance Gula.

The following commonly assigned U.S. patent applications were filed on Oct. 12, 1988 and all relate to molded case circuit breakers: Ser. No. 256,881, entitled SCREW ADJUSTABLE CLINCH JOINT WITH BOSSES, by James N. Altenhof, Ronald W. Crookston, Walter V. Bratkowski and J. Warren Barkell; Ser. No. 256,879 entitled TAPERED STATIONARY CONTACT LINE COPPER, by Ronald W. Crookston; and Ser. No. 256,878, entitled TWO-PIECE CRADLE LATCH FOR CIRCUIT BREAKER, by Alfred E. Maier and William G. Eberts.

The following commonly assigned U.S. patent applications also relate to molded case circuit breakers: Ser. No. 260,848, filed on Oct. 21, 1988, entitled UNRIVETED UPPER LINK SECUREMENT, by Joseph Changle and Lance Gula; Ser. No. 07/331,769, filed on Apr. 3, 1989, entitled Kurt Grunert and Glen Sisson; and Ser. No. 07/331,920, filed on Mar. 31, 1989, entitled EXTENDER SPRING FOR INCREASED MAGNETIC TRIP SETTINGS, by Kurt Grunert.

The following two commonly owned patent applications were filed on Apr. 25, 1989: Ser. No. 07/343,047, entitled TWO-PIECE CRADLE LATCH, KEY BLOCKS AND SLOT MOTOR FOR CIRCUIT BREAKER, by Alfred E. Maier, William G. Eberts and Richard E. White, and Ser. No. 07/342,820, entitled TWO-PIECE CRADLE LATCH, HANDLE BARRIER LOCKING INSERT AND COVER INTERLOCK FOR CIRCUIT BREAKER by A. D. Carothers, D. A. Parks, R. E. White and W. G. Eberts.

Commonly owned patent application Ser. No. 07/374,370 was filed on June 30, 1989, entitled REVERSE SWITCHING MEANS FOR MOTOR OPERATOR, by Kurt Grunert and Charles Paton.

Lastly, commonly owned patent application Ser. No. 07/389,849 was filed on Aug. 14, 1989, entitled TRIP INTERLOCK DESIGN, by Kurt Grunert, Ronald Cheski, Robert Tedesco, Michael J. Whipple, Melvin A. Carrodus and James G. Maloney.

BACKGROUND OF THE INVENTION

1. Field of the Invention

This invention relates to molded case circuit breakers and more particularly to improved joints for fastening a form wound shunt, wound from a continuous strip of an electrical conductor, to a contact arm subassembly.

2. Description of the Prior Art

Molded case circuit breakers are generally old and well known in the art. Examples of such circuit breakers are disclosed in U.S. Pat. Nos. 4,489,295; 4,638,277; 4,656,444 and 4,679,018. Such circuit breakers are used to protect electrical circuitry from damage due to an overcurrent condition, such as an overload and relatively high level short circuit. An overload condition is about 200–300% of the nominal current rating of the circuit breaker. A high level short circuit condition can be 1000% or more of the nominal current rating of the circuit breaker.

Molded case circuit breakers include at least one pair of separable contacts which may be operated either manually by way of a handle disposed on the outside of the case or automatically in response to an overcurrent condition. In the automatic mode of operation the contacts may be opened by an operating mechanism or by a magnetic repulsion member. The magnetic repulsion member causes the contacts to separate under relatively high level short circuit conditions. More particularly, magnetic repulsion members are connected between a pivotally mounted contact arm assembly and a stationary conductor assembly. Each magnetic repulsion member is a generally V-shaped member defining two depending legs, form wound from laminated strips of copper. During high level short circuit conditions, magnetic repulsion forces are generated between the depending legs of the magnetic repulsion members as a result of the current flowing therethrough which, in turn, causes the pivotally mounted contact arm assembly to blow open.

The pivotally mounted contact arm assembly is formed as a laminated assembly consisting of a plurality of contact arm subassemblies. Each subassembly includes a contact arm portion, which carries a movable main or arcing contact, and a stationary conductor portion, normally fastened to the circuit breaker frame. The free ends of the flexible shunt or magnetic repulsion member are disposed in keyholes formed in the stationary conductor portion and the contact arm portions forming a pair of joints.

In known contact arm subassemblies, for example, as disclosed in U.S. Pat. No. 4,891,618, and assigned to the same assignee as the present invention, the joints are soldered for mechanical strength and for improving the electrical conductivity of the joints. In order to prevent wicking of the solder into the copper laminations, the joints are staked before the soldering process.

Such a process for making such joints can be relatively expensive from a manufacturer's standpoint because it involves two operations for the joint: staking and soldering. Also in such a process the electrical resistance of the joints formed is dependent, in part, upon the contact between the free ends of the shunt and the keyholes. Thus, any tolerances in the components could cause irregular contact between the surfaces thereby increasing the electrical resistance of the joint; an undesirable condition.

SUMMARY OF THE INVENTION

It is an object of the present invention to provide a contact arm subassembly which solves the problems associated with the prior art.

It is yet another object of the present invention to provide a circuit breaker having contact arm subassemblies with improved joints for attaching a flexible shunt.

It is a further object of the present invention to provide a joint for a contact arm subassembly that is relatively inexpensive from a manufacturing standpoint.

Briefly, the present invention relates to a laminated contact arm assembly formed from a plurality of contact arm subassemblies. Each subassembly includes a contact arm portion for carrying a movable main or arcing contact, and a stationary conductor portion. A flexible shunt, form wound from a flat electrical conductor, is used to connect the contact arm portion to the stationary conductor portion. The flexible shunt is formed into a V-shape defining two depending legs. The free ends of the shunt define bulb portions which are inserted into keyholes formed in the contact arm portion and the stationary conductor portion. A pin is centrally inserted into the bulb portion to exert radially outward forces against the interior surface of the keyhole to increase the force between the bulb portions and the interior surfaces of the keyholes to form joints having a lower electrical resistance. The pin may be inserted into the central portion of the bulb by orbital riveting.

DESCRIPTION OF THE DRAWING

These and other objects and advantages of the present invention will become readily apparent upon consideration of the following detailed description and attached drawing wherein:

FIG. 8 is an enlarged cross-sectional view taken along the line 8—8 of FIG. 7.

DETAILED DESCRIPTION

Figure 1:
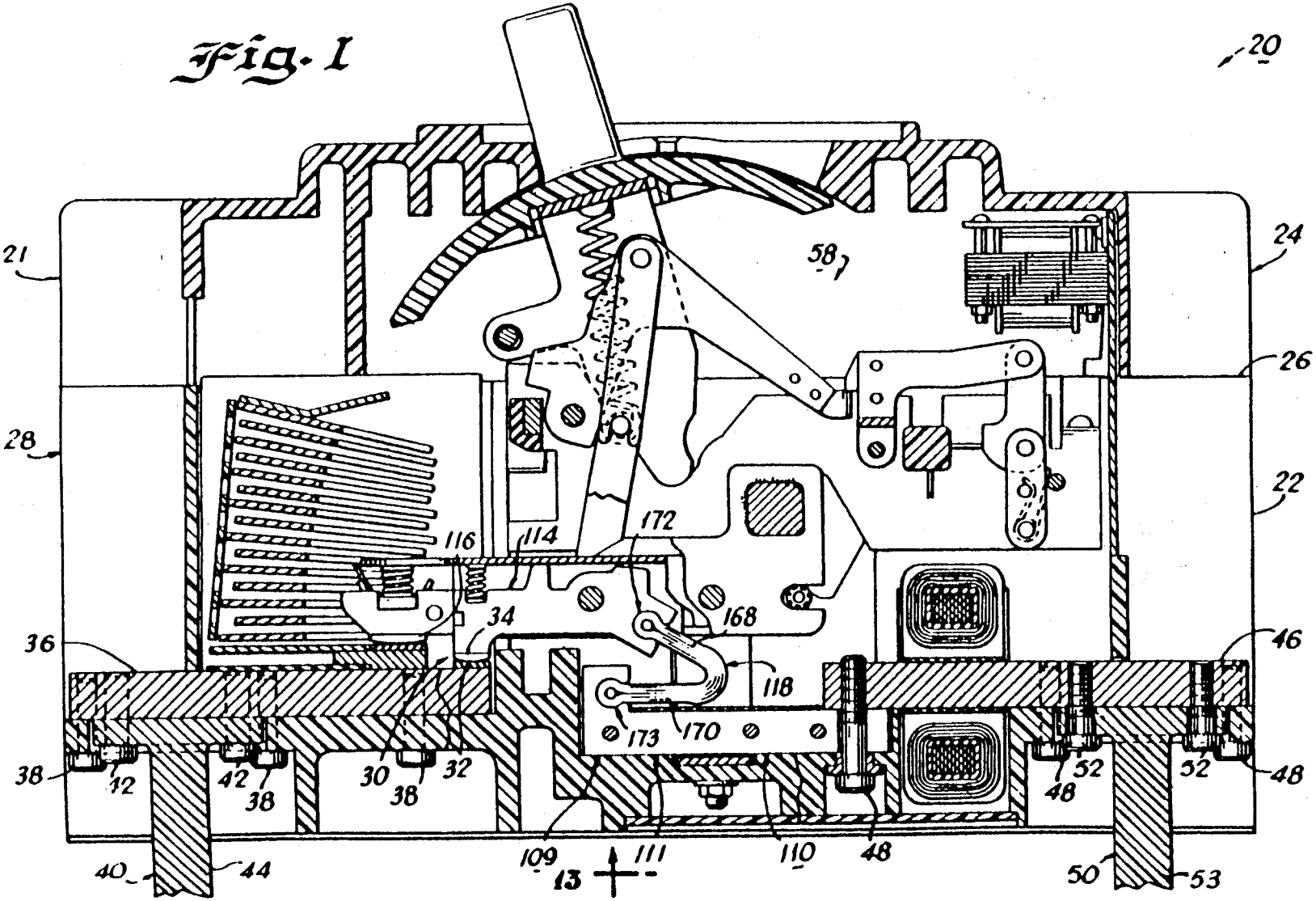
FIG. 1 is a cross-sectional view of a circuit breaker which incorporates the present invention.
Figure 2:
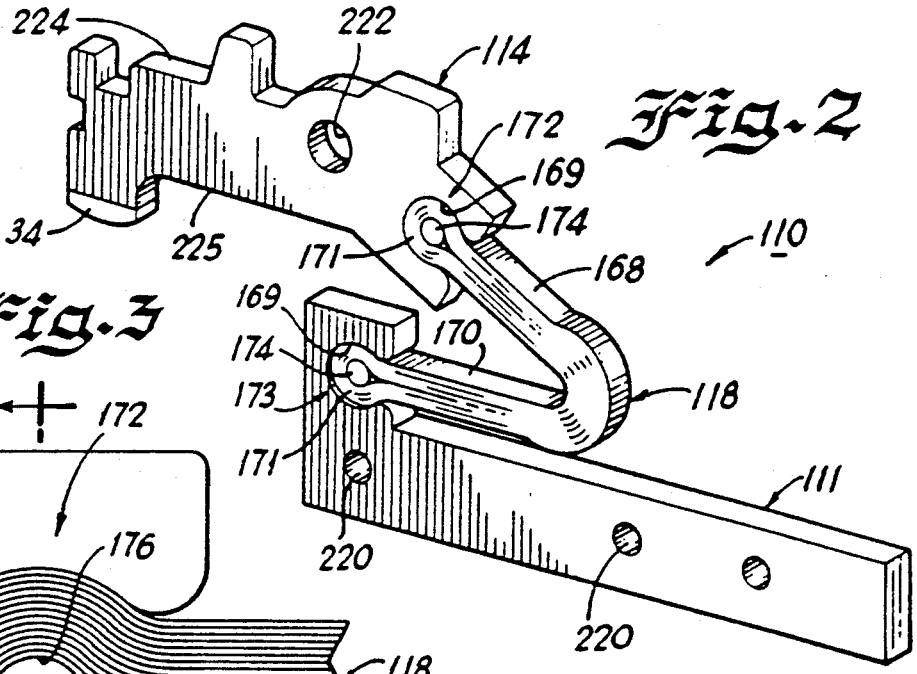
FIG. 2 is a perspective view of a contact arm subassembly in accordance with the present invention.
Figure 3:
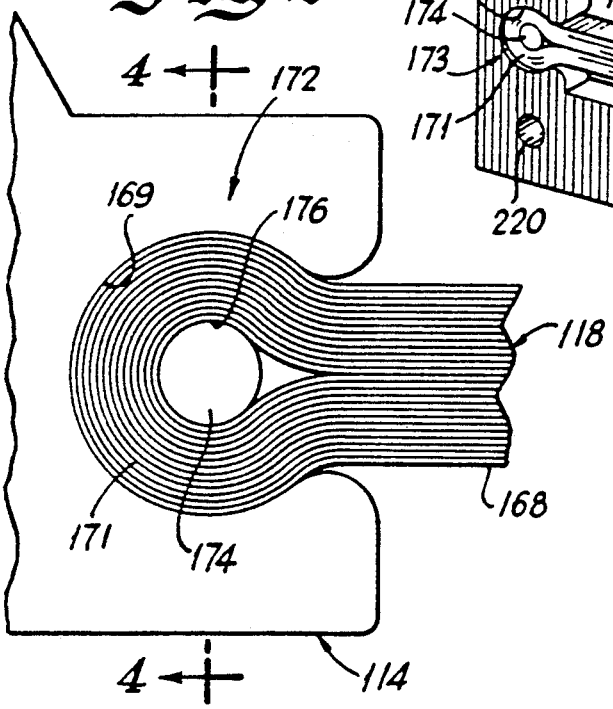
FIG. 3 is an enlarged elevational view of a portion of FIG. 2.

A molded case circuit breaker, generally indicated by the reference numeral 20, comprises an electrically insulated housing 21 having a molded base 22 and a molded coextensive cover 24, assembled at a parting line 26. The internal cavity of the base 22 is formed as a frame 28 for carrying the various components of the circuit breaker. As illustrated and described herein, a Westinghouse Series C, R-frame molded case circuit breaker will be described. However, the principles of the present invention are applicable to various types of molded case circuit breakers.

At least one pair of separable main contacts 30 are provided within the housing 21. More specifically, a main pair of contacts 30 are provided which include a fixed main contact 32 and a movable main contact 34. The fixed main contact 32 is electrically connected to a line side conductor 36, bolted to the frame 28 with a plurality of fasteners 38. A T-shaped stab 40 is fastened to the line side conductor 36 with a plurality of fasteners 42. A depending leg 44 of the stab 40 extends outwardly from the rear of the circuit breaker housing 21. This depending leg 44 is adapted to plug into a line side conductor disposed on a panelboard (not shown).

Similarly, the movable main contact 34 is electrically connected to a load side conductor 46 fastened to the frame 28 with a plurality of fasteners 48. Another T-shaped stab 50 is connected to the load side conductor 46 with a plurality of fasteners 52. A depending leg 53 of the stab 50, which extends outwardly from the rear of the circuit breaker housing 21, is adapted to plug into a load side conductor within a panelboard (not shown).

An operating mechanism 58 is provided for opening and closing the main contacts 30. The operating mechanism 58 as well as the other components within the circuit breaker 20 are described in detail in U.S. Pat. No. 4,891,618, assigned to the same assignee as the present invention and hereby incorporated by reference.

A laminated contact assembly 109 is formed from a plurality of contact arm subassemblies 110. The contact arm subassemblies 110 are fastened together to form the laminated contact assembly 109. Several different types of contact subassemblies 110 may be used to form the contact assembly 109 as discussed in detail in U.S. Pat. No. 4,891,618.

The contact arm subassemblies 110 include a stationary conductor portion 111 and a contact arm portion 114. Some of the contact arm portions 114 carry the movable main contacts 34, while some are used to carry arcing contacts 116 as discussed in the aforementioned U.S. patent. The contact arm portions 114 are coupled to stationary conductor portions 111 by way of repulsion members or flexible shunts 118.

The shunt or magnetic repulsion members 118 are laminated members, form wound from a continuous, thin flat strip of an electrical conductive material, such as copper, forming a laminated magnetic repulsion member 118. The form wound shunt member 118 is formed into a V-shaped member defining a pair of depending legs 168 and 170. The shunt 118 as well as the contact assembly 109 and contact subassemblies 110 are described in detail in U.S. Pat. No. 4,891,618.

The free ends of the depending legs 168 and 170, define bulb portions 171 which are inserted into keyholes 169 formed in the stationary conductor portion 111 and the contact arm portions 114 to form a pair of joints 172 and 173. Once the bulb portions 171 are inserted into the keyholes 169, a pin or rivet 174, formed from an electrical conducting material, such as copper, is disposed in an aperture 176 formed in the central portion of the bulb portions 171 within the keyholes 169. The pin 174 is formed with an initial length 178, slightly longer than the width of the shunt 118. After processing as discussed below, the finished length 178 of the pin 174 should be substantially the width of the shunt 118 to avoid interference with adjacent subassemblies 110.

The selection of the length 178 of the pin 174 is well within the ordinary skill in the art and is a function of the orbital riveting process described below. The diameter of the pin 174 is substantially the same as the diameter of the aperture 176 in the bulb portion 171. The pin 174 may be formed with chamfered ends to facilitate insertion.

Figure 7:
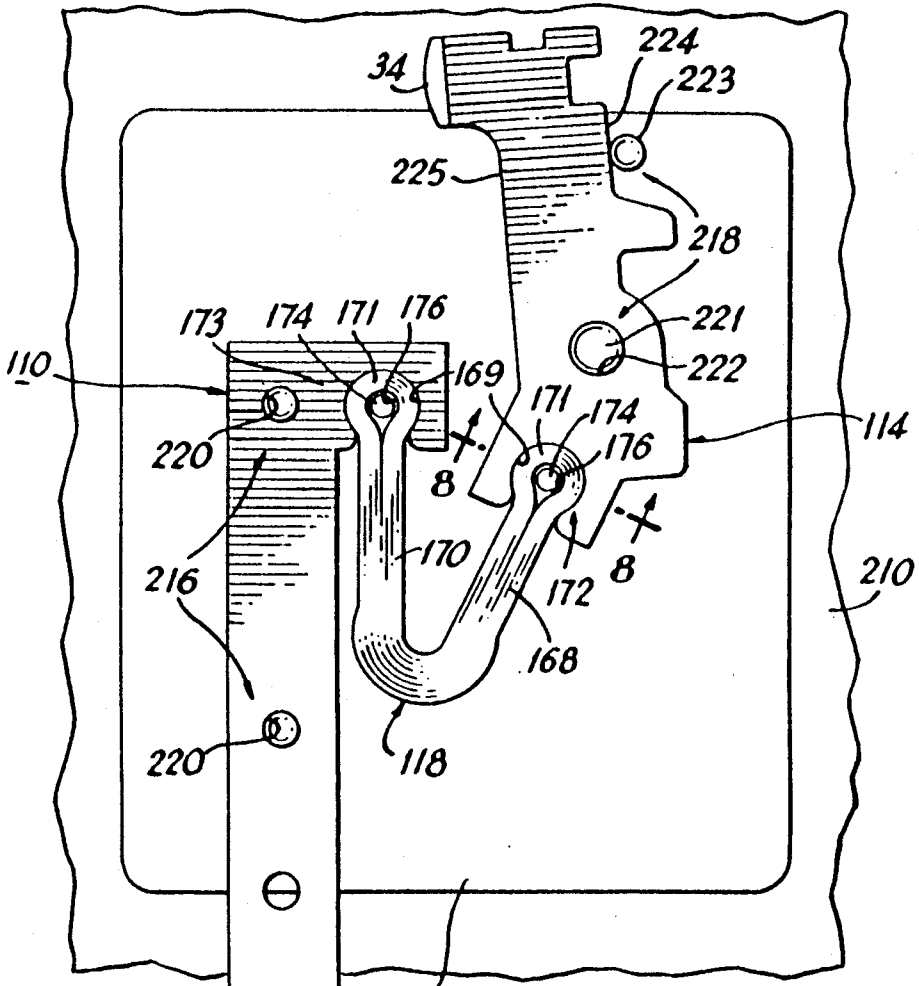
FIG. 7 is a plan view taken along the line 7—7 of FIG. 6.
Figure 6:
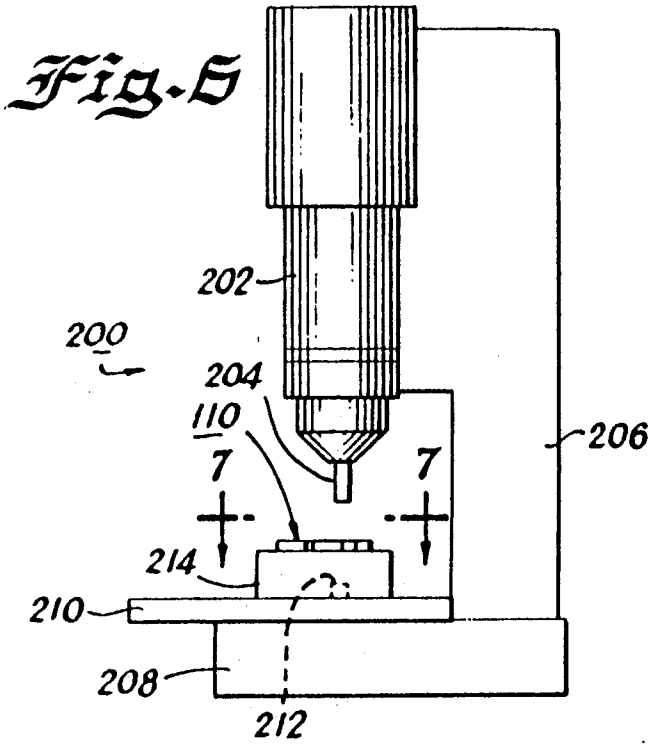
FIG. 6 is a side elevational view of the orbital riveting machine used to fabricate the joints in accordance with the present invention.
Figure 9:
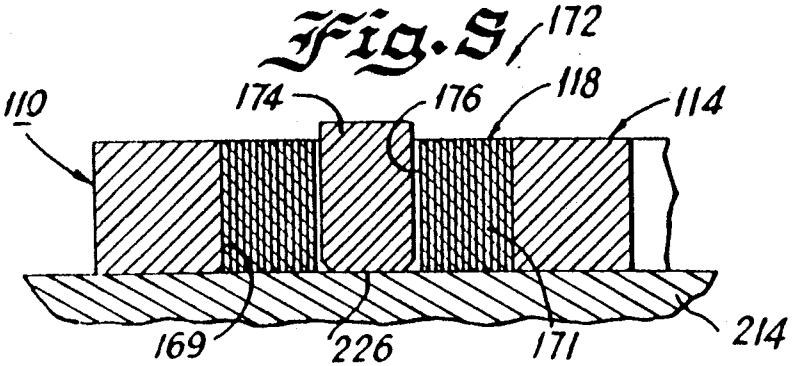

As shown in FIG. 7, each contact arm subassembly 110 is placed in a radial riveting machine 200, such as, for example, a Bracker Model RN-380, commercially available from Bracker, Inc. of Carnegie, Pa. a subsidiary of Baltec Ltd. of Pfaffikon, Switzerland. The orbital riveting machine 200 consists of a spinner 202 having a spinning peen 204, illustrated in FIG. 6, slidably mounted for vertical movement on a fixture 206 having an anvil portion 208 disposed beneath the spinning peen 204. A plate 210, is disposed on the anvil portion 208. The plate 210 is provided with a locating pin 212 for locating the spinning fixture 214 that is carried by the plate 210. The spinning fixture 214 is provided with two pairs of locator pins 216 and 218 for locating the contact arm subassembly 110 on the spinning fixture 214. More specifically, one pair of locator pins 216, generally perpendicular to the surface of the spinning fixture 214, are received in apertures 220 in the stationary conductor portion 111. The other pair of locator pins 218 are used to locate the contact arm portion 114. More specifically, one pin 221 of the pair 218 is received in an aperture 222 provided in the contact arm portion 114. The other pin 223 may be disposed against an edge 224 of the contact arm portion 114 or against an opposite edge 225. In addition to locating the contact arm subassembly 110 on the spinning fixture 214, the locator pins 216, 218 may be located such that the shunt member 118 is prebent as shown in FIG. 7.

The contact arm subassembly 110 should be assembled to the point that the bulb portions 171 of the shunt member 118 are disposed in the keyholes 169 before the contact arm subassembly 110 is placed onto the spinning fixture 214. The contact arm subassembly 110 is then placed on the spinning fixture 214 such that the pins 216 and 218 are properly located with respect to the contact arm subassembly 110. The contact arm subassembly 110 should also be relatively flat with respect to the surface of the spinning fixture 214. Next, two pins 174 formed from electrical conducting material are inserted into the apertures 176 formed in the bulb portions 171 on the shunt 118 for the joints 172 and 173. The pins 174 should be pushed down such that the inserted ends 226 are flat against the surface of the spinning fixture 214.

Air pressure is then applied to the spinner 202. For a Bracker Model No. RN-380, 60–65 pounds per square inch (PSI) is required. If other machines are used, the required air pressure would be in accordance with the manufacturer's specifications for such other machines.

After the air pressure is applied, pins 174 are orbitally riveted by the spinning peen 204. The contact arm subassembly 110 may then be removed from the machine 200.

Figure 4:
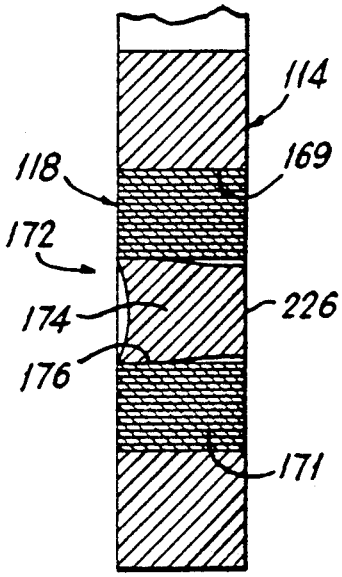
FIG. 4 is a cross-sectional view along the line 4—4 of FIG. 3.
Figure 5:
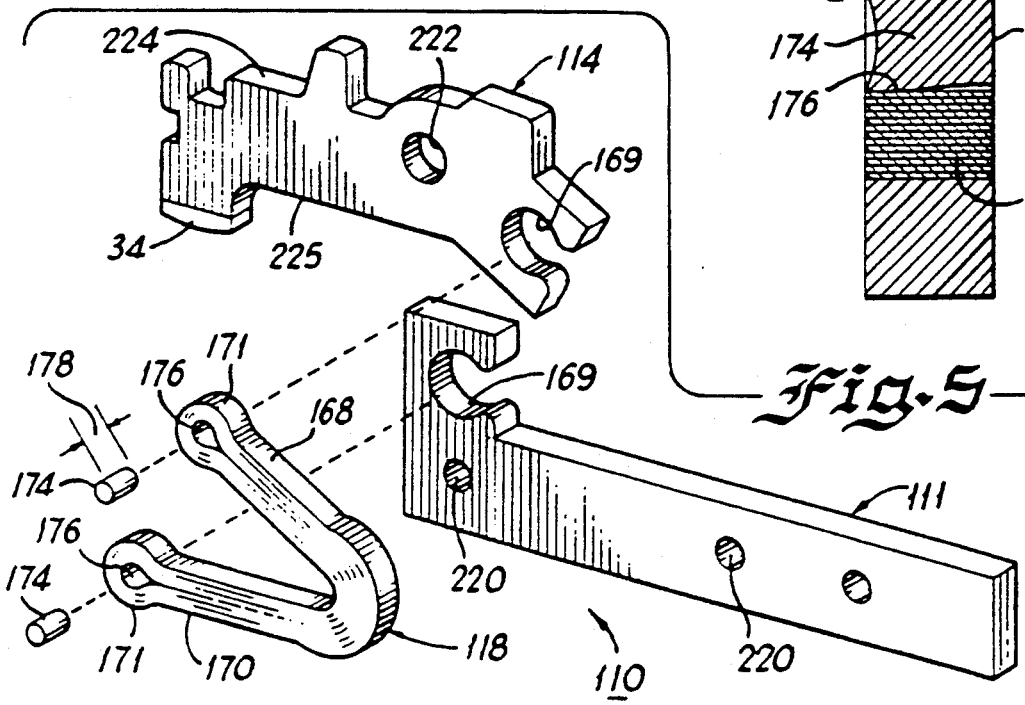
FIG. 5 is an exploded perspective view of the components contained in FIG. 2.

As is known by those of ordinary skill in the art, an orbital riveting process expands such a pin 174 in a radial direction thereby decreasing the length of the pin 174 and increasing the radial diameter of the pin 174 in substantially a conical shape as shown in FIG. 4. The radial expansion of the pin 174 generates radial forces within the aperture 176 to force the laminations of the bulb portions 171 of the shunt 118 against the inner surface of the keyholes 169 to increase the mechanical strength of the joints 172 and 173 to allow the joints 172 and 173 to withstand the forces attendant to operation of the circuit breaker. The increased contact pressure between the components also reduces the electrical resistance of the joints 172 and 173 forming a better electrical joint than, for example, joints formed by staking and soldering as disclosed in U.S. Pat. No. 4,891,618.

In one embodiment of the invention, each pin 174 is orbitally riveted on one side. In order to enhance the electrical conductivity (reduce the electrical resistance of the joints 172 and 173), the shunt 118 may be soldered in whole or in part to the contact arm portion 114 or stationary conductor portion 111 on the side opposite the side that was orbitally riveted. Even without the soldering, the joints 172 and 173 formed by merely orbitally riveting one side of the pin 174 forms a better electrical and mechanical joint than the joint formed by soldering as described in the aforementioned U.S. patent.

In an alternative embodiment of the invention, the contact arm subassembly 110 is placed in a fixture (not shown) such that both ends of one pin 174 can be orbitally riveted at one time. In such an embodiment, two orbital riveters are utilized for each pin 174. More specifically, one orbital riveting machine is disposed on one end of the pin 174 while the other orbital riveting machine is placed on an opposite end. By utilizing two orbital riveting machines for each pin 174, the entire length 178 of the pin 174 may be radially expanded at one time. Alternatively, the contact arm subassembly 110 could be placed in the fixture (not shown) having either two orbital riveting machines 200 or one machine 200 with multiple heads for orbitally riveting both pins 174 on one side at the same time. In this embodiment, after one side of the contact arm subassembly 110 is processed, the subassembly 110 is flipped over for processing on the opposite side for processing.

In another alternate embodiment of the invention, four orbital riveting machines 200 or two machines 200 with multiple heads are contemplated. In this embodiment, two orbital riveting machines 200 (or one machine 200 with multiple heads) are used for each pin 174 to process both pins 174 on both ends at the same time.

Obviously many modifications and variations of the present invention are possible in light of the above teachings. Thus it is to be understood that, within the scope of the appended claims, the invention may be practiced otherwise than as specifically described hereinabove.

What is claimed and desired to be secured by a letters patent is:

1. A molded case circuit breaker comprising:

a base;

a pair of separable main contacts including a movable main contact carried by one or more contact arm subassemblies each having a stationary conductor portion and contact arm portion, disposed within said base: and an operating mechanism for operating said pair of separable main contacts;

wherein each of said contact arm portions and said stationary conductor portions are connected together by a flexible member forming one or more joints formed by disposing free ends of the flexible member defining bulb portions having central apertures into keyholes formed in said contact arm portion and said stationary conductor portion, said bulb portions radially expanded within said keyholes to provide radially outward forces against said keyholes.

2. A molded case circuit breaker as recited in claim 1, further including a pin defining two ends initially having a predetermined length and a predetermined diameter disposed in a central aperture in said bulb portion.

3. A molded case circuit breaker as recited in claim 2, wherein said pin is formed from an electrical conducting material.

4. A molded case circuit breaker as recited in claim 3, wherein said conducting material is copper.

5. A molded case circuit breaker as recited in claim 1, wherein one of said joints is soldered on one side.

6. A molded case circuit breaker as recited in claim 1, wherein both of said joints are soldered on one side.

7. A molded case circuit breaker as recited in claim 2, wherein said bulb portion is radially expanded by radially expanding a portion of said pin by expanding said predetermined diameter and reducing said predetermined length.

8. A molded case circuit breaker as recited in claim 7, wherein the diameter of said pin is radially expanded by an orbital riveting process.

9. A molded case circuit breaker as recited in claim 8, wherein one end of said pin is orbitally riveted.

10. A molded case circuit breaker as recited in claim 8, wherein both ends of said pin are orbitally riveted.

11. A molded case circuit breaker as recited in claim 10, wherein both ends of said pin are orbitally riveted at the same time.

12. A molded case circuit breaker as recited in claim 9 wherein the joints defined by connecting the stationary arm portion and the contact arm portion are also soldered.

13. A molded case circuit breaker comprising:

a base;

a pair of separable main contacts including a movable main contact carried by one or more contact arm subassemblies each having a stationary conductor portion and contact arm portion disposed within said base; and an operating mechanism for operating said pair of separable main contacts;

wherein each of said movable contact arm portions and said stationary conductor portions are connected together by a flexible member forming one or more joints formed by disposing free ends of the flexible member defining bulb portions having central apertures into keyholes formed in said contact arm portion and said stationary conductor portion, said bulb portions radially expanded within said keyholes to provide radially outward forces against said keyholes; each of said joints includes a pin defining two ends initially having a predetermined length and a predetermined diameter disposed in said contact aperture in said bulb portion.

14. A molded case circuit breaker as recited in claim 13, wherein said one end of each of said pins is orbitally riveted into said aperture.

15. A molded case circuit breaker as recited in claim 14, wherein said one end of both of said pins are orbitally riveted at the same time.

16. A molded case circuit breaker as recited in claim 13, wherein both ends of each of said pins are orbitally riveted.

17. A molded case circuit breaker as recited in claim 16, wherein said both ends of both of said pins are orbitally riveted at the same time.

18. A process for making one or more joints for a contact arm subassembly for a molded case circuit breaker comprising the steps of:

(a) providing a stationary conductor portion having a keyhole;

(b) providing a contact arm portion having a keyhole;

(c) providing a flexible member having free ends defining bulb portions having a central aperture;

(d) disposing said bulb portions into said keyholes; and (e) radially expanding said bulb portions within said keyholes.

19. A process as recited in claim 18, further including the step of providing a pin having an initial predetermined diameter and predetermined length.

20. A process as recited in claim 19, further including the step of disposing said pin within said central aperture in said bulb portion and radially expanding the diameter of said pin within said central aperture.

21. A process as recited in claim 20, wherein the diameter of said pin is radially expanded and disposed in said central aperture by orbital riveting.

* * * * *